US007629939B2

(12) United States Patent
Deng et al.

(10) Patent No.: US 7,629,939 B2
(45) Date of Patent: Dec. 8, 2009

(54) BROADBAND DUAL POLARIZED BASE STATION ANTENNA

(75) Inventors: Gang Yi Deng, Irvine, CA (US); John J. Dickson, Cypress, CA (US); Tim Gossard, Corona, CA (US)

(73) Assignee: Powerwave Technologies, Inc., Santa Ana, CA (US)

( * ) Notice: Subject to any disclaimer, the term of this patent is extended or adjusted under 35 U.S.C. 154(b) by 0 days.

(21) Appl. No.: 11/729,647

(22) Filed: Mar. 29, 2007

(65) Prior Publication Data

US 2007/0229385 A1 Oct. 4, 2007

Related U.S. Application Data

(60) Provisional application No. 60/787,442, filed on Mar. 30, 2006.

(51) Int. Cl.
*H01Q 9/16* (2006.01)
*H01Q 21/00* (2006.01)

(52) U.S. Cl. ..... 343/821; 343/799; 343/810; 343/816; 343/820

(58) Field of Classification Search ..... 343/793, 343/797, 799, 810, 816, 819, 820, 821
See application file for complete search history.

(56) References Cited

U.S. PATENT DOCUMENTS

| | | | | |
|---|---|---|---|---|
| 5,692,927 | A | 12/1997 | Tiihonen et al. | |
| 5,952,983 | A | 9/1999 | Dearnley et al. | |
| 6,034,649 | A | 3/2000 | Wilson et al. | |
| 6,072,439 | A | 6/2000 | Ippolito et al. | |
| 6,285,336 | B1 | 9/2001 | Zimmerman | |
| 6,310,584 | B1 | 10/2001 | Reece et al. | |
| 6,313,809 | B1 * | 11/2001 | Gabriel et al. | 343/797 |
| 6,333,720 | B1 * | 12/2001 | Gottl et al. | 343/810 |
| 6,366,258 | B2 * | 4/2002 | Reece et al. | 343/816 |
| 6,529,172 | B2 * | 3/2003 | Zimmerman | 343/797 |
| 6,819,300 | B2 * | 11/2004 | Gottl | 343/799 |
| 6,822,618 | B2 | 11/2004 | Bisiules et al. | |
| 6,831,615 | B2 * | 12/2004 | Gottl | 343/797 |
| 6,940,465 | B2 * | 9/2005 | Gottl et al. | 343/797 |
| 2002/0135528 | A1 | 9/2002 | Teillet et al. | |
| 2004/0252071 | A1 | 12/2004 | Bisiules et al. | |
| 2005/0219140 | A1 | 10/2005 | Browne et al. | |
| 2005/0231437 | A1 | 10/2005 | Dai et al. | |

FOREIGN PATENT DOCUMENTS

| | | |
|---|---|---|
| WO | WO 99/62139 | 12/1999 |
| WO | WO 01/69714 | 9/2001 |
| WO | WO 02/50945 | 6/2002 |

OTHER PUBLICATIONS

Supplementary European Search Report and Search Opinion for Application No. 07754157.1 dated May 07, 2009.

* cited by examiner

*Primary Examiner*—Hoang V Nguyen
(74) *Attorney, Agent, or Firm*—Myers Andras Sherman LLP

(57) ABSTRACT

A dual polarized broadband base station antenna for wireless communication systems is disclosed. The present invention employs a dual polarized boxed arrangement radiation element with high isolation between polarization channels. Plural radiating elements project outwardly from the surface of a ground plane. The antenna elements are paired dipoles.

20 Claims, 16 Drawing Sheets

1

10

13A

1A

1B

1C

1D

BROADBAND DUAL POLARIZED BASE STATION ANTENNA

RELATED APPLICATIONS

This application claims the benefit under 35 U.S.C. 119(e) of U.S. provisional patent application Ser. No. 60/787,442, filed on Mar. 30, 2006, incorporated herein by reference in its entirety.

FIELD OF THE INVENTION

The present invention relates to antennas for receiving and/or transmitting electromagnetic signals. More particularly, the present invention relates to base station antennas for wireless communication systems.

BACKGROUND OF THE INVENTION

Many wireless applications require transmission and/or reception on orthogonal linear polarizations. In some applications, transmission is performed with one polarization and reception is performed with an orthogonal polarization in order to provide isolation between the transmitted and received signals. In other application, electromagnetic energy is received on both polarizations and the signals are combined to increase the signal-to-noise ratio, providing polarization diversity gain.

Since a wireless telecommunication system can suffer from multi-path fading, diversity reception is often used to address severe multi-path fading. A diversity technique requires at least two signal paths that carry the same information but have uncorrelated multi-path fadings. Several types of diversity reception are used in base stations, including space diversity, direction diversity, polarization diversity, frequency diversity and time diversity. Polarization diversity uses orthogonal polarization to provide uncorrelated paths. The sense or direction of linear polarization of an antenna is measured from a fixed axis and can vary, depending on system requirements. In particular, the sense of polarization can range from vertical polarization (0 degrees) to horizontal polarization (90 degrees). Conventionally, the most prevalent types of linear polarization used in wireless systems are those which use vertical/horizontal and +45°/−45° polarization (slant 45°). When an antenna assembly receives or transmits signals with two normally orthogonal polarizations, such an antenna assembly is referred to as dual polarized antenna assembly. Such dual polarized antennas must meet a certain port-to-port isolation specification. There is a need for improved port-to-port isolation in dual polarized antennas.

BRIEF SUMMARY OF THE INVENTION

The present invention provides an antenna assembly for receiving and/or transmitting electromagnetic signals, comprising a dual polarized radiation element comprising a square arrangement of plural radiating elements, wherein the plural radiating elements form paired dipoles. In one embodiment, the square arrangement of plural radiating elements provides better than 30 dB isolation between the polarization channels. Each radiating element comprises a dipole antenna, and the antenna assembly further includes a ground plane wherein each dipole antenna projects outwardly from the ground plane. Each paired dipole comprises a pair of radiating elements with radiating arms in parallel configuration, wherein a common feed line pattern provides a common input to the paired dipole. Further, each radiation element includes two paired dipoles in a box configuration, wherein each paired dipole comprises a pair of radiating elements in parallel configuration, each paired dipole having a common feed line pattern providing a common input to that paired dipole. The radiating elements can be oriented such that one paired dipole provides +45° polarization and another paired dipole provides −45° polarization.

In another embodiment, the present invention provides a broadband dual polarized base station antenna comprising a ground section including a ground plane, and a communication means for dual polarized communication of signals with better than 30 dB level isolation between polarization channels, wherein said communication means projects outwardly from a surface of the ground plane. The communication means comprises at least one radiation element including a dual polarized square arrangement of plural radiating elements, wherein the plural radiating elements form paired dipoles. At least one radiation element comprises plural radiation elements in arranged in a row. In each radiation element, the radiating elements are further oriented such that one paired dipole provides +45° polarization and another paired dipole provides −45° polarization, wherein the plural radiation elements are arrange in a row on the ground plane such that the radiation elements have parallel +45° polarization axis, and parallel −45° polarization axis. In one version, the communication means is configured for operating in the 806 to 960 MHz frequency band, or in the 380 to 470 MHz frequency band, or in the 1710 to 2170 MHz frequency band, or in one or more of 380 to 470 MHz, 806 to 960 MHz, and 1710 to 2170 MHz frequency bands. In another version, the communication means is configured for operating in one or more of 2.3 GHz, 2.4 GHz, 2.5 GHz, 3.5 GHz and 5.8 GHz frequency bands.

In another embodiment the present invention provides an antenna assembly for receiving and/or transmitting electromagnetic signals, comprising a ground plane, and plural radiation elements, each radiation element comprising a square arrangement of plural radiating elements, wherein the plural radiating elements project outwardly from a surface of the ground plane, and the plural radiating elements form paired dipoles with a common feed line pattern. Each radiating element comprises a dipole antenna including a first conductor extending transversely from a surface of the ground plane and electrically connected to the ground plane, the first conductor comprising a first radiating arm projecting outwardly therefrom, and a second conductor spaced from the ground plane by a dielectric and extending transversely relative to the surface of the ground plane, the second conductor comprising a second radiating arm projecting outwardly therefrom, wherein the first and second conductors are spaced from one another by a gap, and the first and second radiating arms project outwardly in essentially opposite directions. These and other features, aspects and advantages of the present invention will become understood with reference to the following description, appended claims and accompanying figures.

DETAILED DESCRIPTION OF THE INVENTION

The present invention provides a dual polarized broadband base station antenna assembly for wireless communication systems. In one embodiment, the antenna assembly employs a dual polarized boxed arrangement radiation element with improved isolation between polarization channels. The box arrangement (box configuration) provides improved port-to-port isolation (isolation between polarization channels), wherein in one embodiment the isolation level is better than 30 dB. The radiation element includes plural dipole antennas, wherein each dipole antenna has a paired strips line feed. The microstrip to paired strips line transition is very broad band. The boxed shape arrangement improves the isolation dramatically. Such antenna design may be used for a "cellular" frequency band e.g. 806-960 MHz. Alternatively, the same design may operate at e.g. the 380-470 MHz band. Another band is e.g. 1710-2170 MHz. However, the antenna design may also be employed in a number of other frequency bands as well, such as WiMax 2.3 GHz, 2.5 GHz, 3.5 GHz, WiFi 2.4 GHz, 5.8 GHz frequency bands, etc.

Figure 1A:
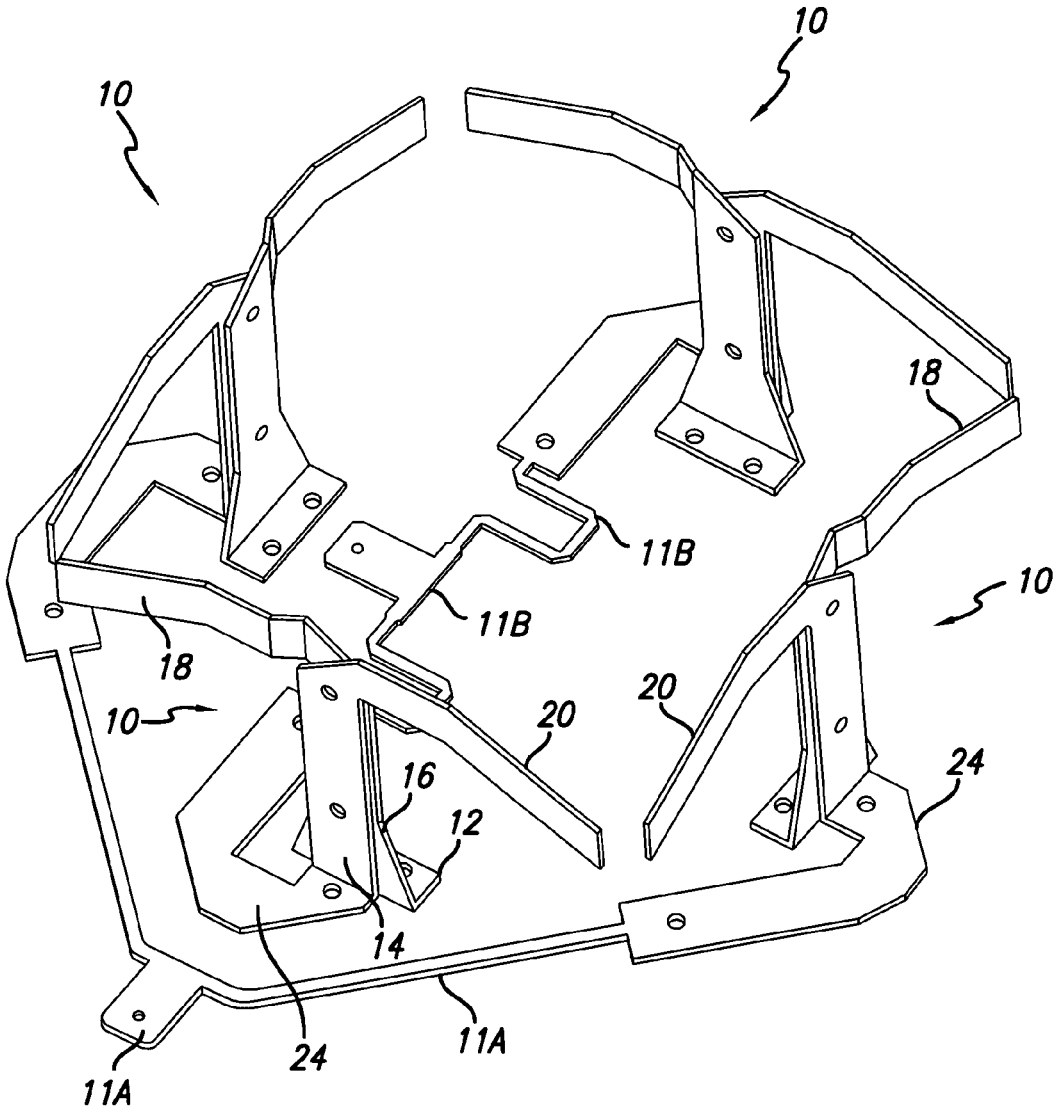
FIG. 1*a* shows an isometric view of an example dual polarized radiation element with mirrored dipole pairs, in accordance with the present invention.

FIG. 1*a* shows an example dual polarized boxed arrangement radiation element 1 with mirrored dipoles, for use in a dual polarized antenna with isolation between polarization channels according to the present invention. The radiation element 1 comprises plural dipole antennas (radiating elements) 10 arranged in a general square configuration to provide a boxed arrangement (FIG. 1*a*). In a preferred embodiment, the radiation element 1 comprises four dipole antennas 10.

Figure 1B:
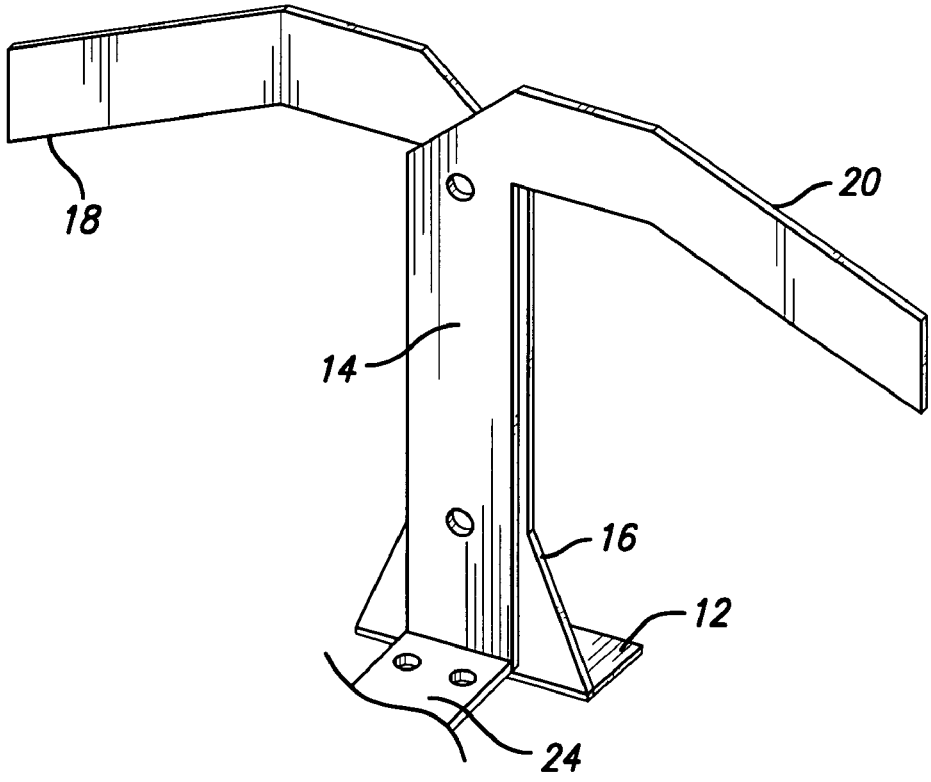
FIG. 1*b* shows an isometric view of one of the dipole antennas in FIG. 1*a*, according to an embodiment of the present invention.
Figure 1C:
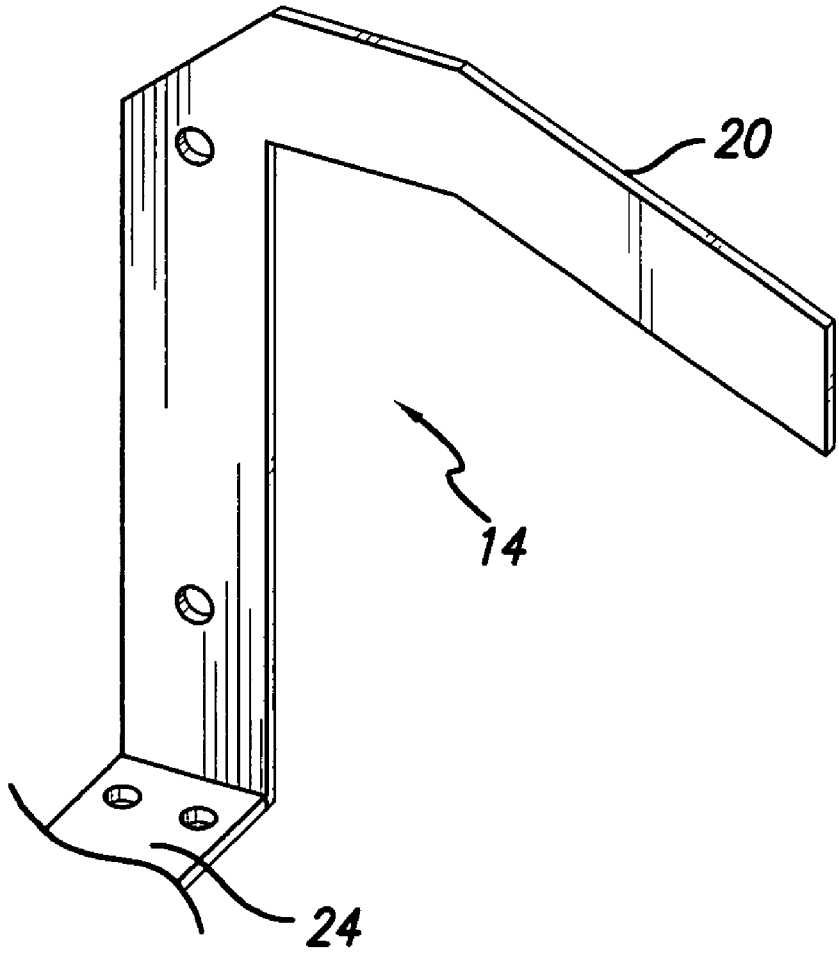
FIG. 1*c* shows one of the dipole arms of the dipole antenna in FIG. 1*b*, according to an embodiment of the present invention

As shown in FIGS. 1*b-c*, each dipole antenna 10 includes two arms (radiating members) 18, 20, a ground plate 12 and two electrical conductors/legs 14 and 16. FIG. 1*b* shows an isometric view of a single dipole antenna 10. The arms 18. 20 can be straight or curved. The conductor 16 is attached to ground using the plate 12, with a dipole arm 18 (FIG. 1*d*) towards one side, while the other conductor 14 is spaced to the ground by a dielectric, such as air, foam, etc., with a dipole arm 20 (FIG. 1*c*) towards the opposite side of dipole arm 18, therefore forming a dipole configuration. Each dipole arm forms a radiating section. In this example, the conductor 14 and dipole arm 20 are formed/stamped from a sheet of conductive material, forming an L-shape. Further, the conductor 16 and dipole arm 18 are formed/stamped from a sheet of conductive material, forming an L-shape. The input conductors 14 and 16 are separated by a gap 22 (e.g., FIG. 8*a*). The conductor 14 connects a part of the dipole arm 20 to a feed line 24 and the conductor 16 connects a part of the dipole arm 18 to ground via the plate 12. The conductors 14 and 16 form a paired strips transmission line having an impedance. The arms 18, 20 also have an impedance. The impedance of the paired strips transmission line 14, 16, is adjusted by varying the width of conductor sections 14, 16 and/or the gap 22 therebetween. The specific dimensions vary with the application. As such, the impedance of the corresponding feed section is adjusted to match the intrinsic input impedance of each dipole. The two conductor sections 14, 16 of the dipole antenna form a balanced paired strips transmission line; therefore, it is unnecessary to provide a balun. This provides the antenna 10 with a very wide impedance bandwidth. Also, the antenna 10 has a stable far-field pattern across the impedance bandwidth.

Figure 1D:
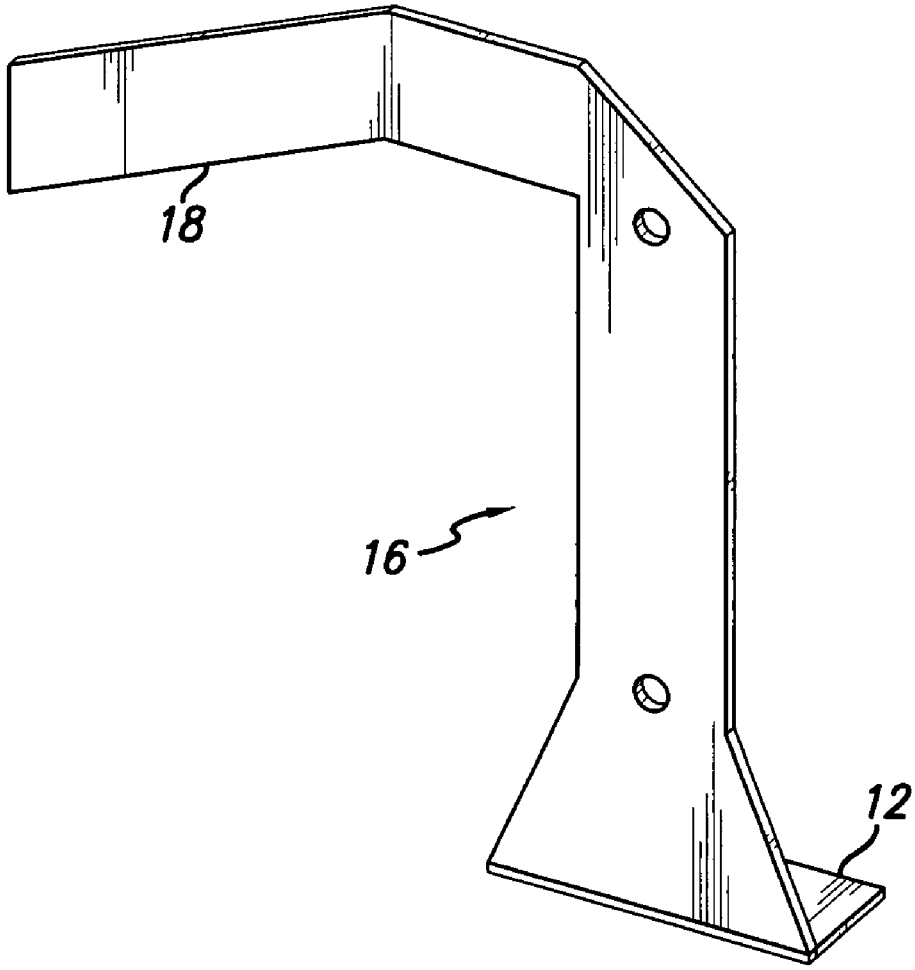
FIG. 1*d* shows another one of the dipole arms of the dipole antenna in FIG. 1*c*, according to an embodiment of the present invention.

FIG. 1*d* shows the dipole arm 18 that can be attached to a ground plane via the plate 12 and FIG. 1*c* shows the dipole arm 20 with the microstrip feed line 24 attached. The feed line 24 (and its extension feed line 11A or 11B) comprises a microstrip feed line spaced from the ground plane by non-conductor such as air dielectric (e.g., 31 in FIG. 9). A similar spacing mechanism can be used for spacing the conductor 14 from the ground plane 5. The impedance of the microstrip line is adjusted by varying the width of the line 24, and/or the space between the microstrip line to the ground plane. The feed line 24 is shown as a unitary element of the conductor 14. The conductor section 16 can be connected to the ground plane by any suitable fastening device such as a nut and bolt, a screw, a rivet, or any suitable fastening method including soldering, welding, etc. The suitable connection provides both an electrical and mechanical connection between the conductor 16 and ground plane.

Figure 2:
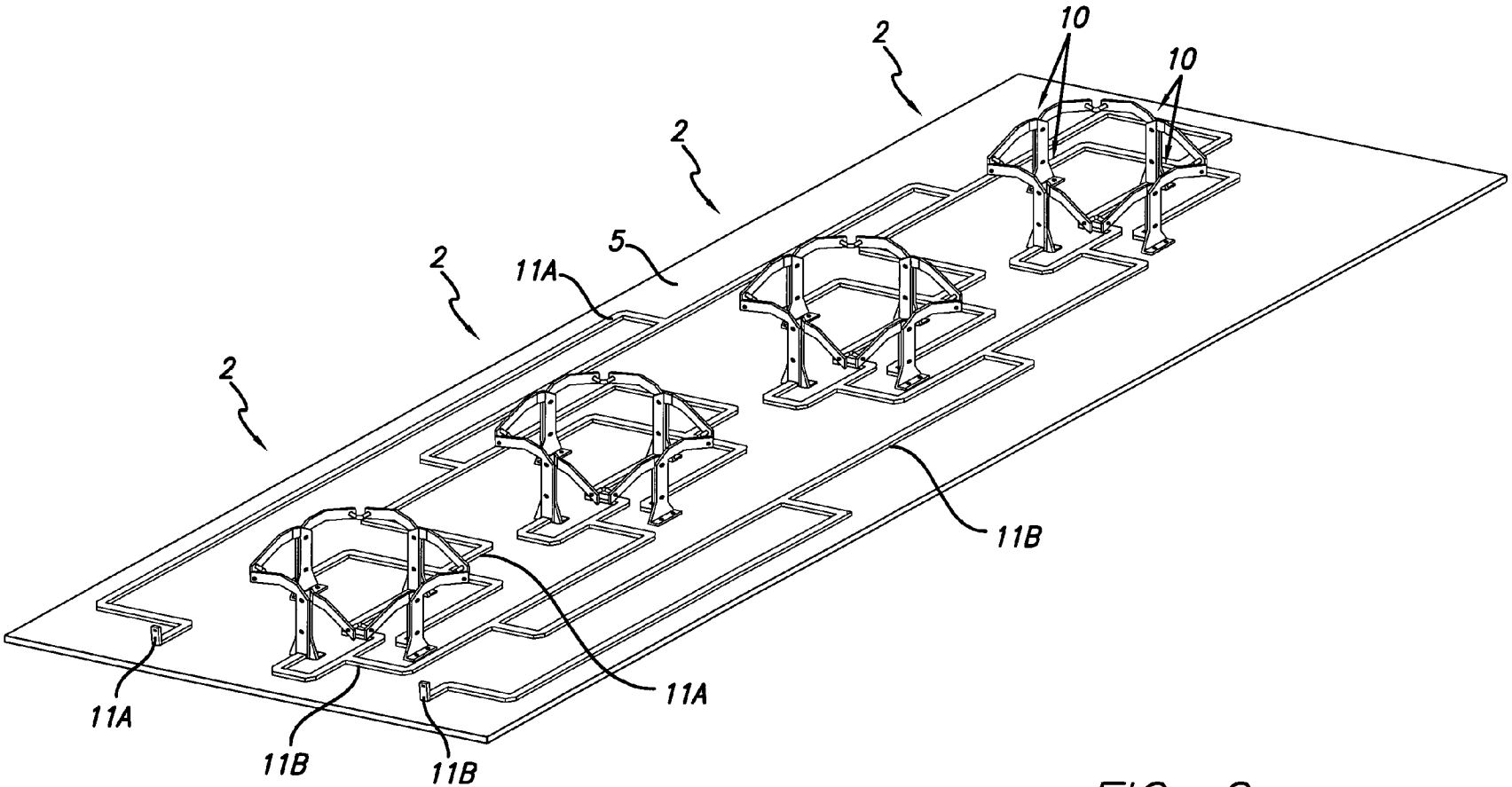
FIG. 2 shows an isometric view of plural dual polarized radiation elements configured on a ground plane in horizontal and vertical orientation, according to an embodiment of the present invention.

FIG. 2 shows another example wherein plural radiation elements 2 are configured on a ground plane 5, according to the present invention. Each dipole antenna 10 forms a dipole, and has two neighboring (adjacent) orthogonal dipole antennas in the box shape of a radiation element 2, and one parallel (across) dipole antenna in said box shape. The box dipole formed by each dipole antenna 10 couples strongly with its neighboring orthogonal dipoles 10. However, if two parallel dipoles are fed with equal phase and amplitude and are arranged symmetrically with respect to the orthogonal dipole (s), then the coupled energy from one neighboring dipole will be of equal magnitude and opposite phase as energy from the other neighboring dipole. Then the two coupled fields therefore cancel out. The isolation between two polarization channels will be improved dramatically because of the boxed dipole arrangement. The antennas 10 are paired with a common feed pattern (e.g., 11A or 11B) providing a common input.

Figure 5:
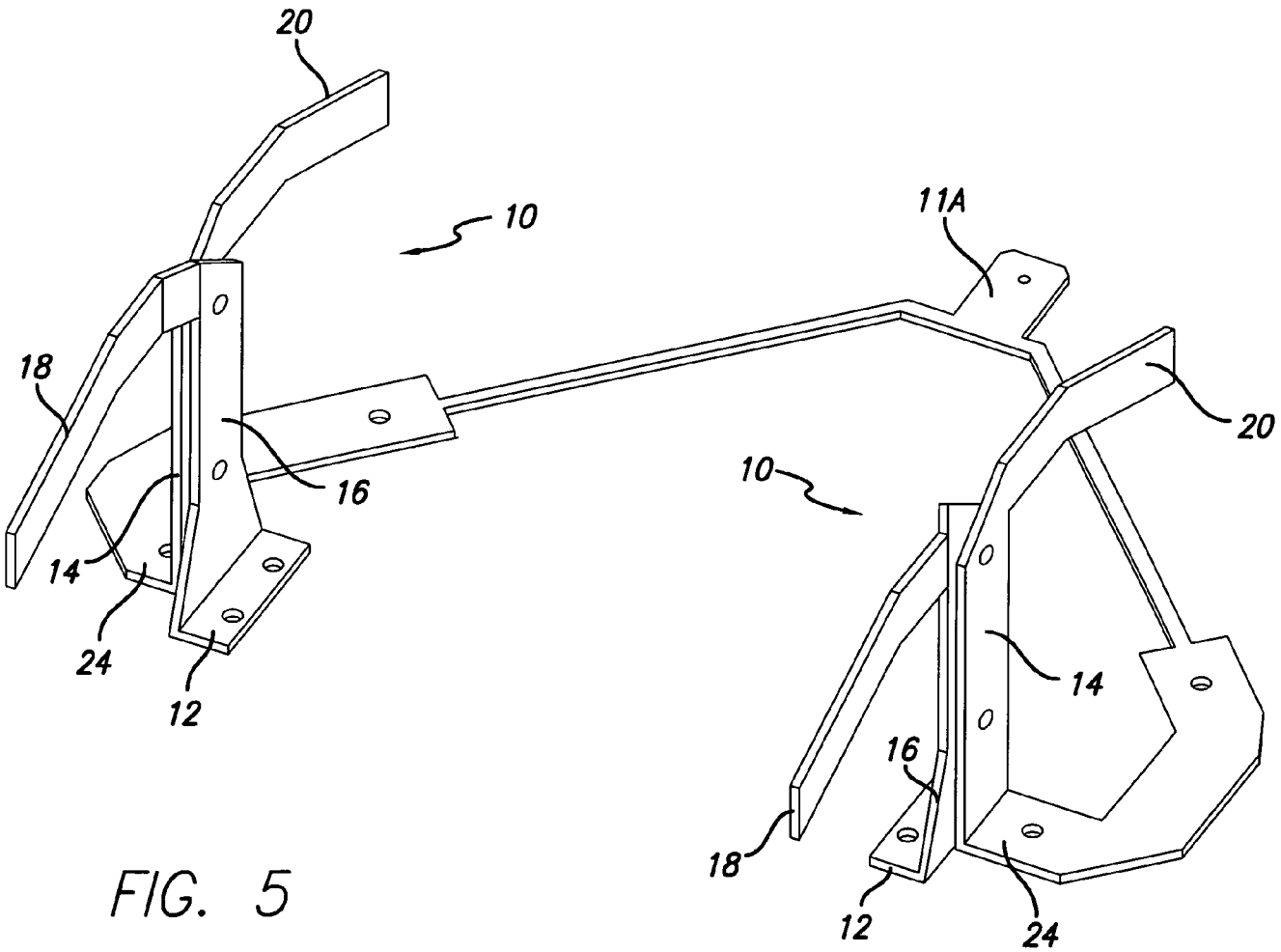
FIG. 5 shows the isometric view of a +45° dipole pair in the dual polarized radiation element of FIG. 1*a*, according to an embodiment of the present invention.
Figure 6:
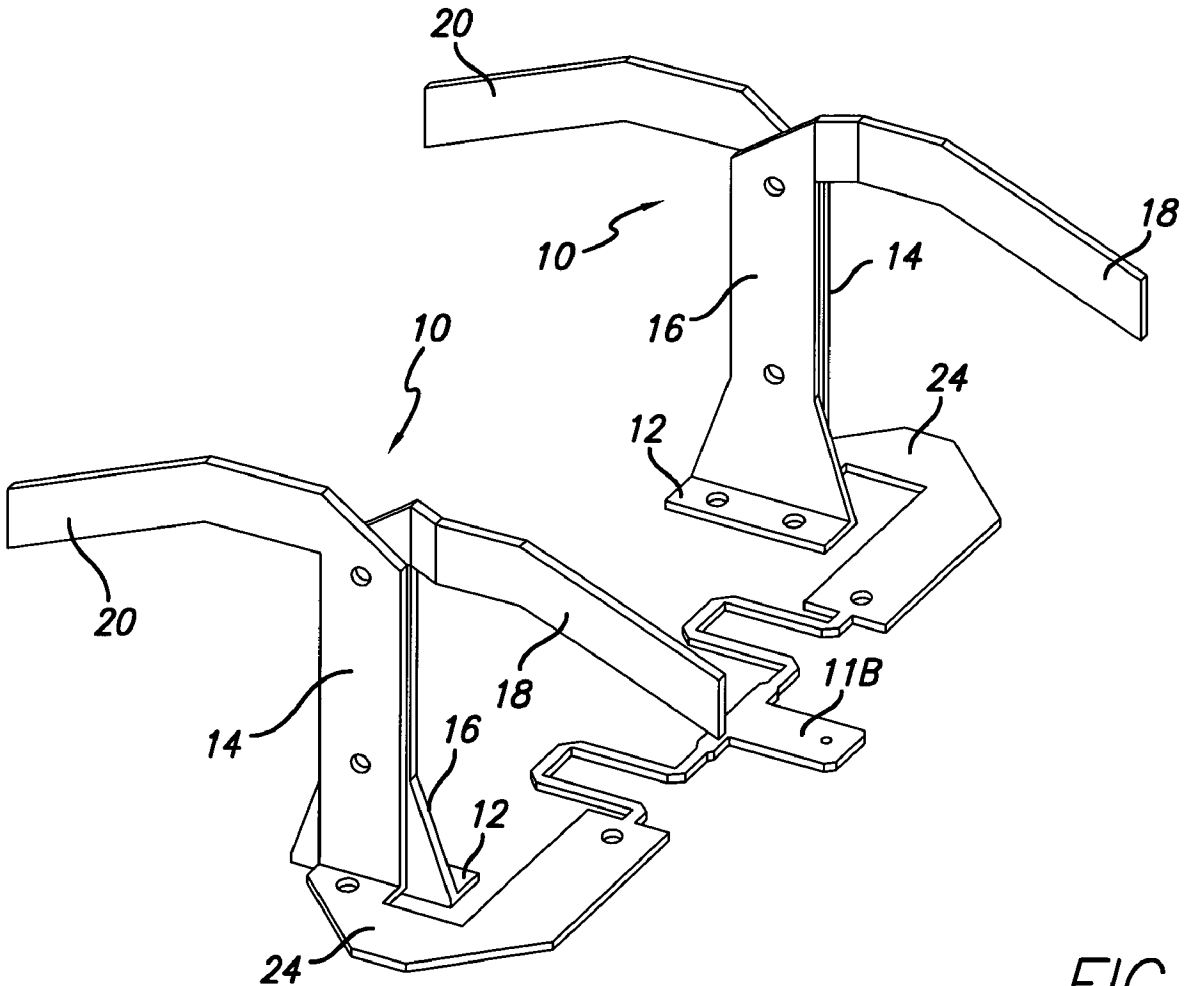
FIG. 6 shows the isometric view of a −45° dipole pair in the dual polarized radiation element of FIG. 1*a*, according to an embodiment of the present invention.

FIG. 5 shows a pair of dipole antennas 10 forming a +45° polarization radiating dipole antenna pair (dipole pair A) with a common feed line 11A. FIG. 6 shows another pair of dipole antennas 10 forming a −45° polarization radiating dipole antenna pair (dipole pair B) with a common feed line 11B. The dipole pairs A and B are arranged to obtain the square configuration ±45° polarization radiation element 1 in FIG. 1*a*. Plural radiation elements 1 can be arranged in an array.

Figure 3:
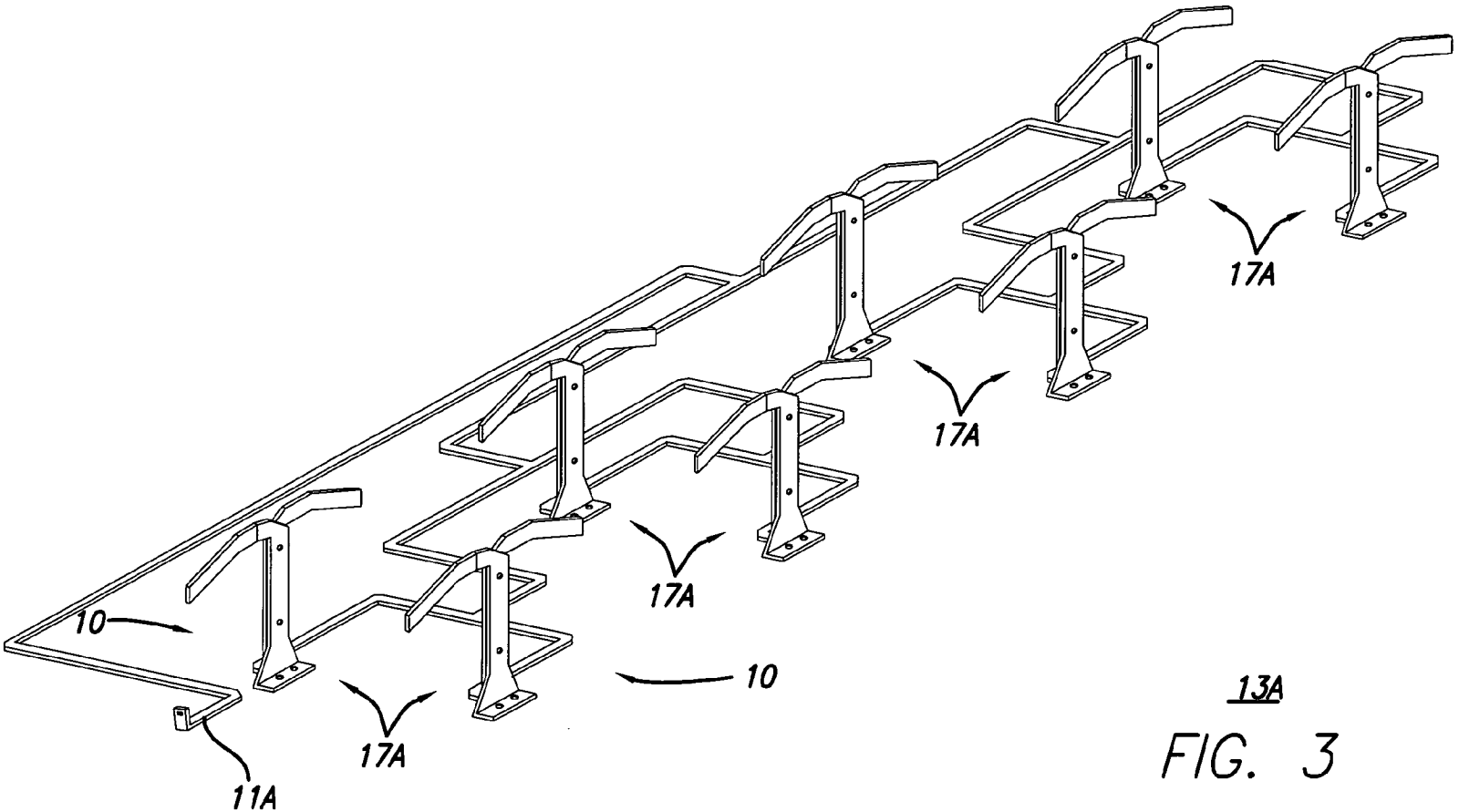
FIG. 3 shows an array of dipole pairs from the radiation elements in FIG. 2, having a common feed line, according to an embodiment of the present invention.
Figure 4:
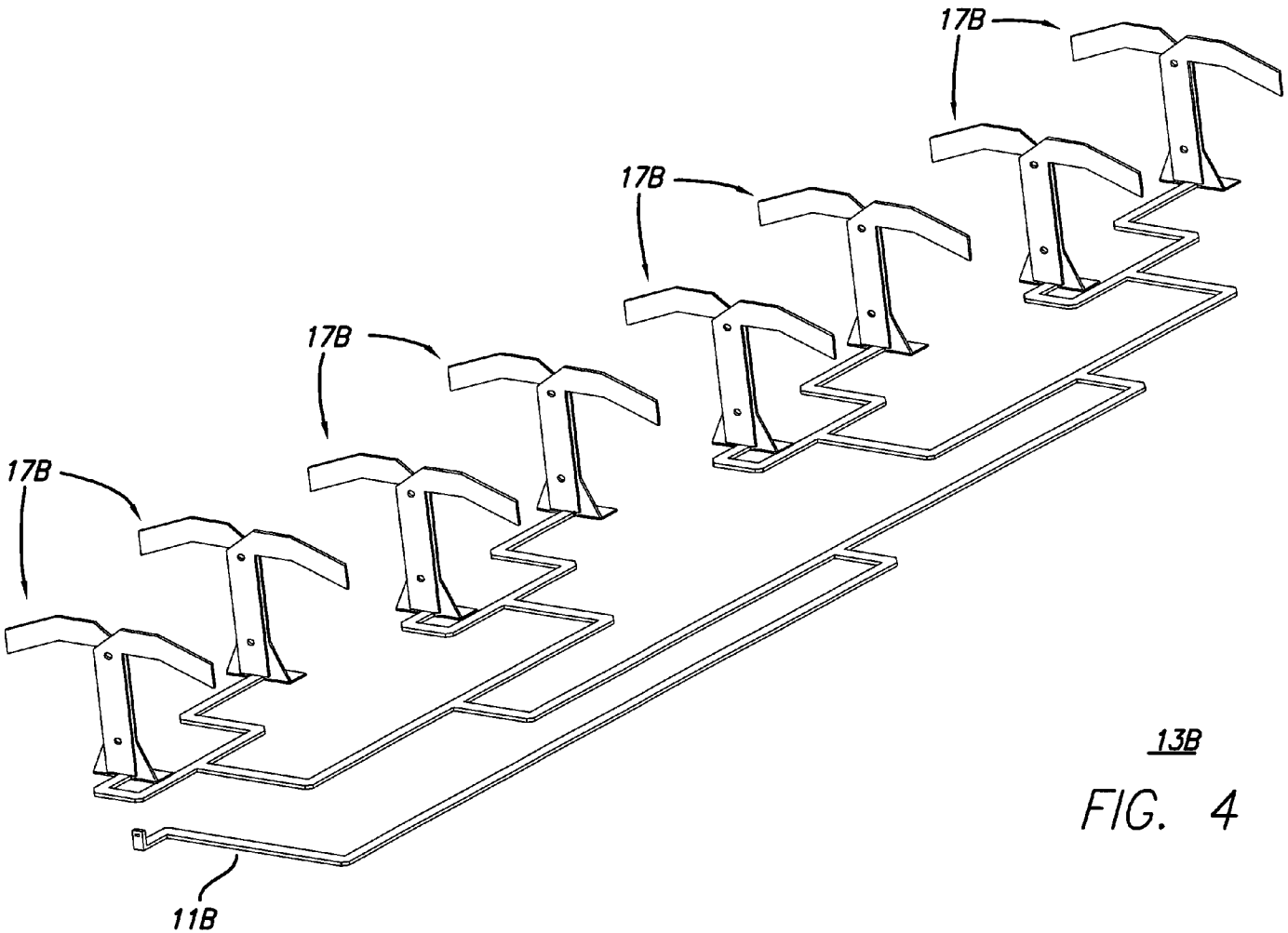
FIG. 4 shows another array of dipole pairs from the radiation elements in FIG. 2, having a common feed line, according to an embodiment of the present invention.

FIG. 3 shows an array 13A of four dipole pairs 17A having a common feed line 11A. Each dipole pair 17A comprises a pair of antennas 10. FIG. 4 shows another array 13B of four dipole pairs 17B, having a common feed line 11B. The arrays 13A and 13B are arranged to obtain the configuration of four radiation elements 1 shown in FIG. 2. The ground plane 5 has a length and a vertical axial along the length, and the dipole radiating antennas 10 project outwardly (transversely) from a surface of the ground plane 5.

Figure 7A:
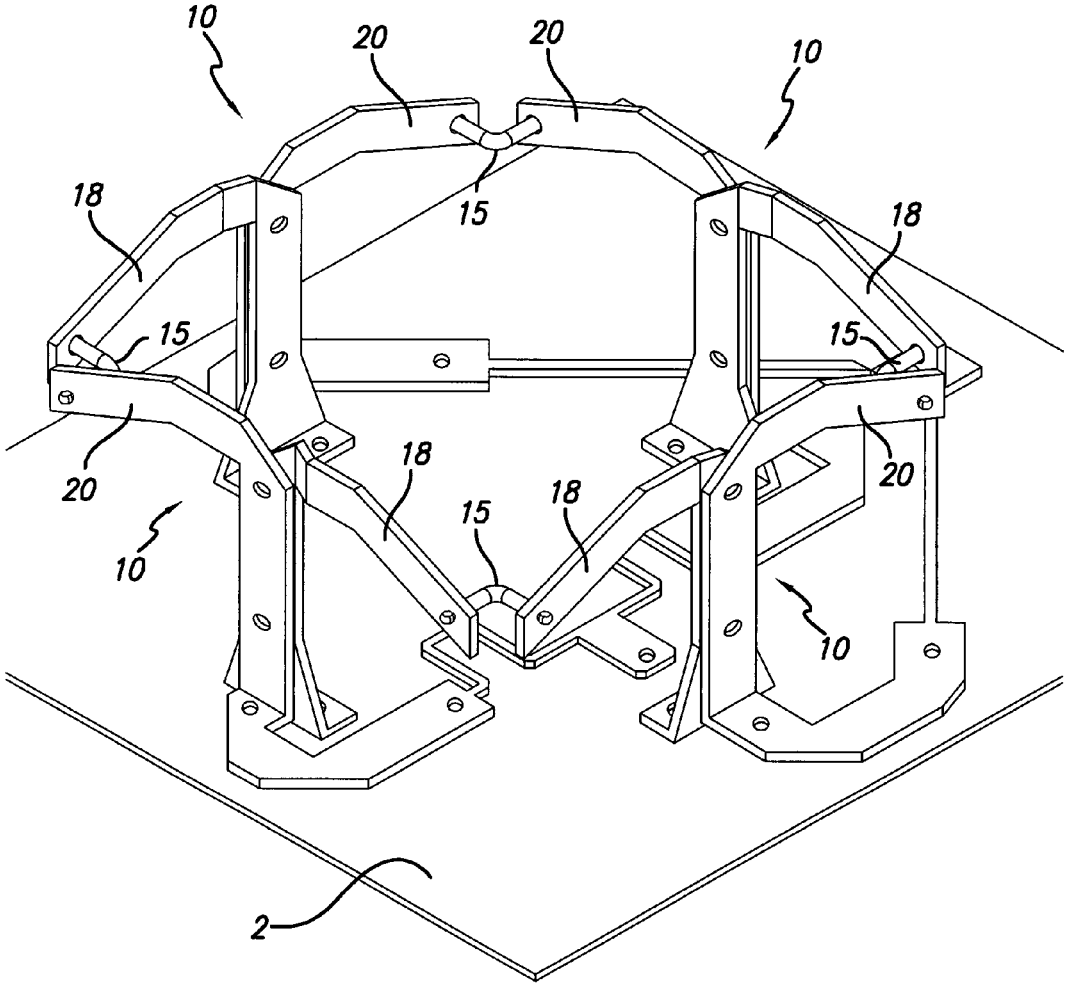
FIG. 7*a-c* show how examples of using a clip to hold adjacent dipole antennas together, according to the present invention.
Figure 7B:
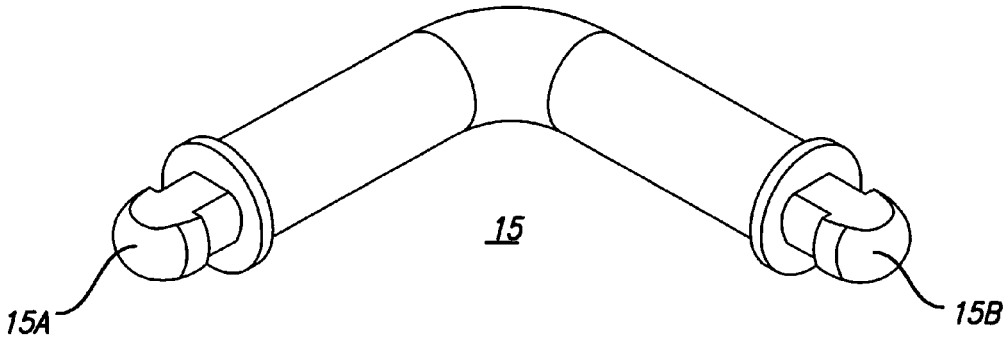
Figure 7C:
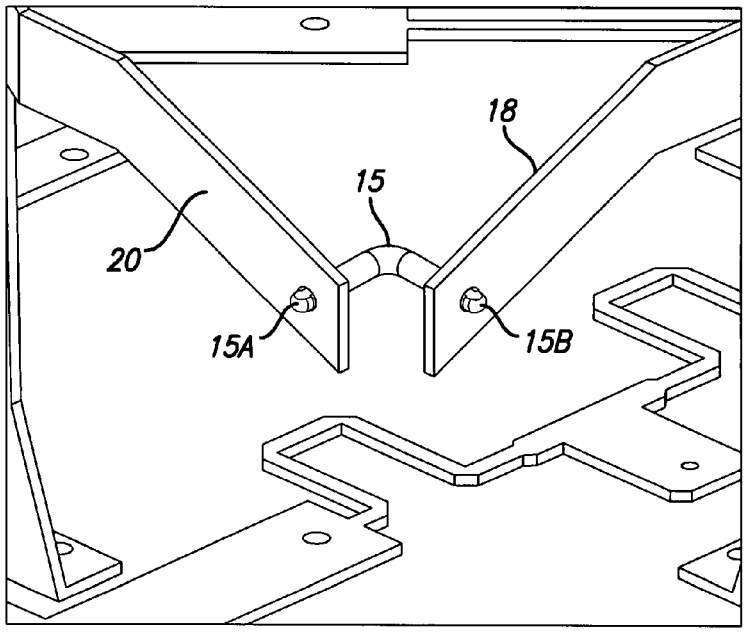

FIG. 7*a* shows how a non-conducting clip 15 (e.g., plastic clip) may be employed to hold a pair of adjacent (orthogonal) dipole antennas 10 together, to form an essentially square configuration for four dipole antennas 10. As shown in FIG. 7*b*, each clip 15 is L-shaped with ends 15A, 15B, which as FIG. 7*c* shows by example in more detail, snap into holes in the arms 20, 18, respectively of two orthogonal dipole antennas 10 to hold the orthogonal antennas together. As those skilled in the art will recognize, other ways of hold the orthogonal antennas together are possible. As such, the present invention is not limited to the examples shown in FIGS. 7*a-c*.

Figure 8A:
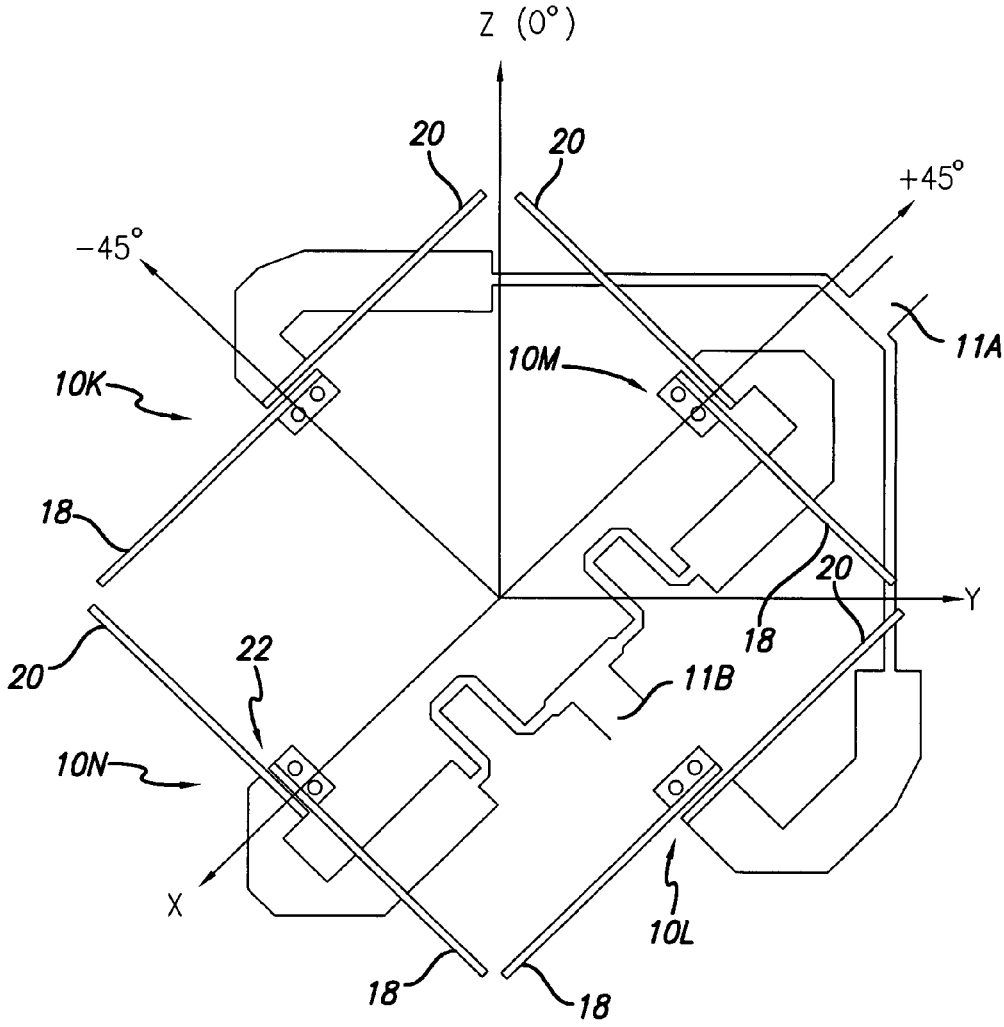
FIG. 8*a-d* show a top view of four examples of box dipole arrangements, according to the present invention.
Figure 8B:
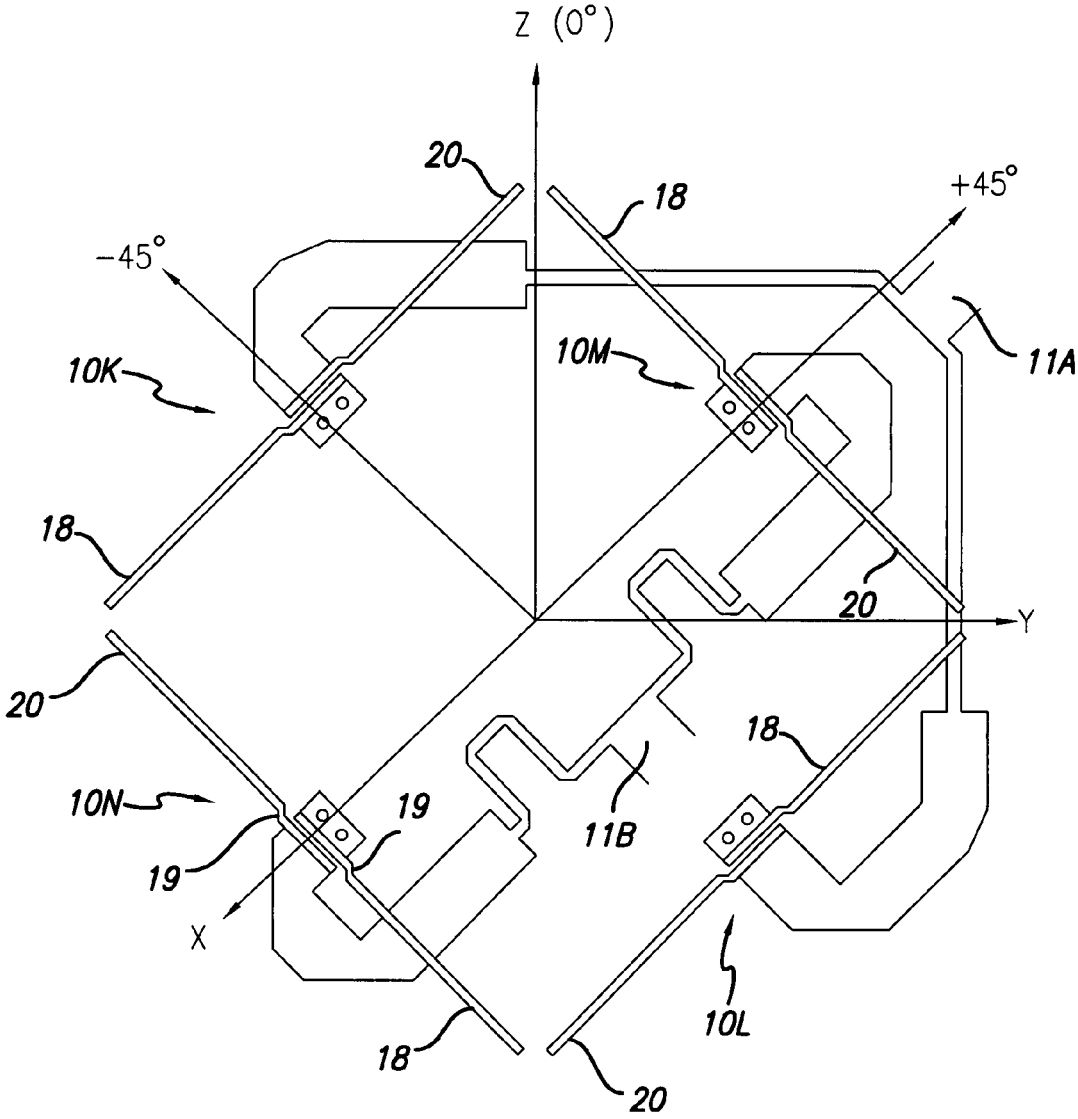
Figure 8C:
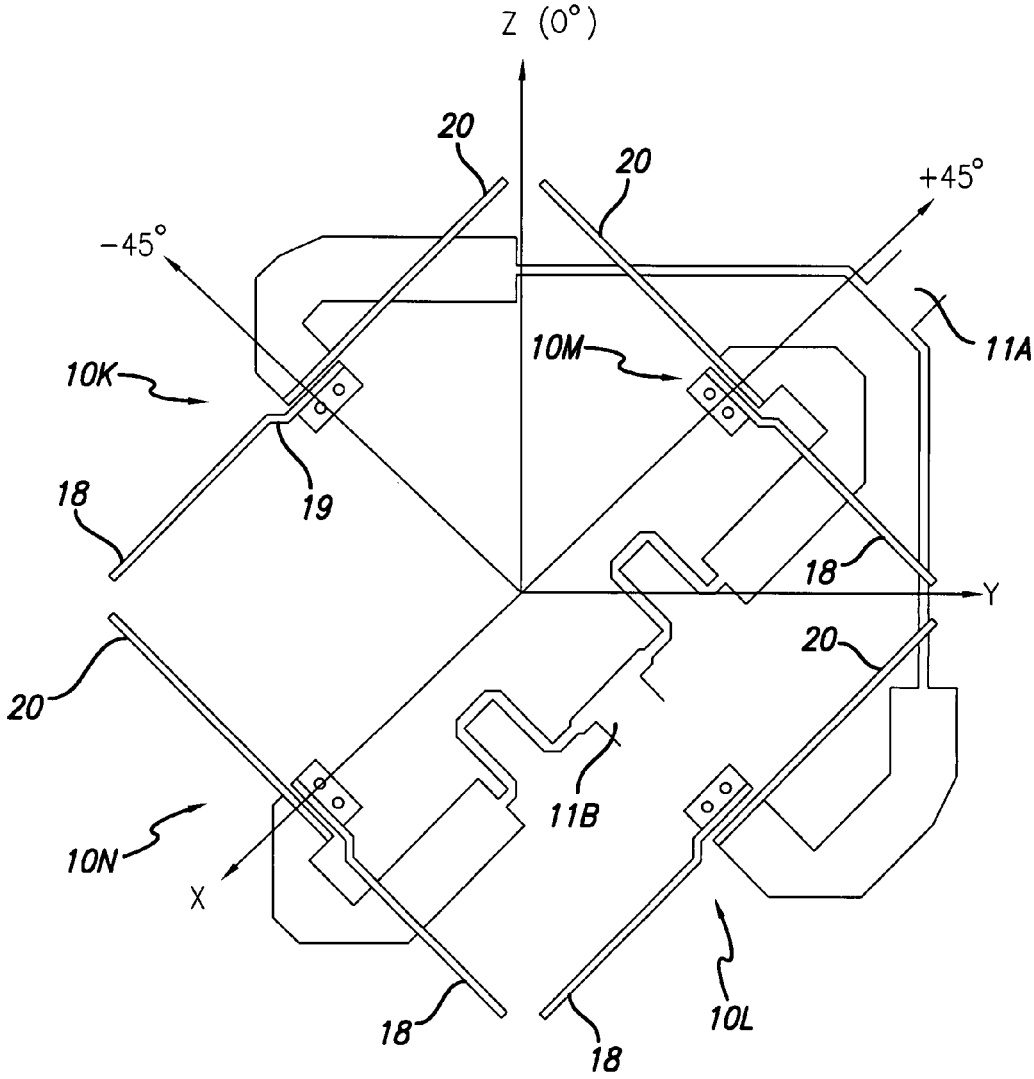
Figure 8D:
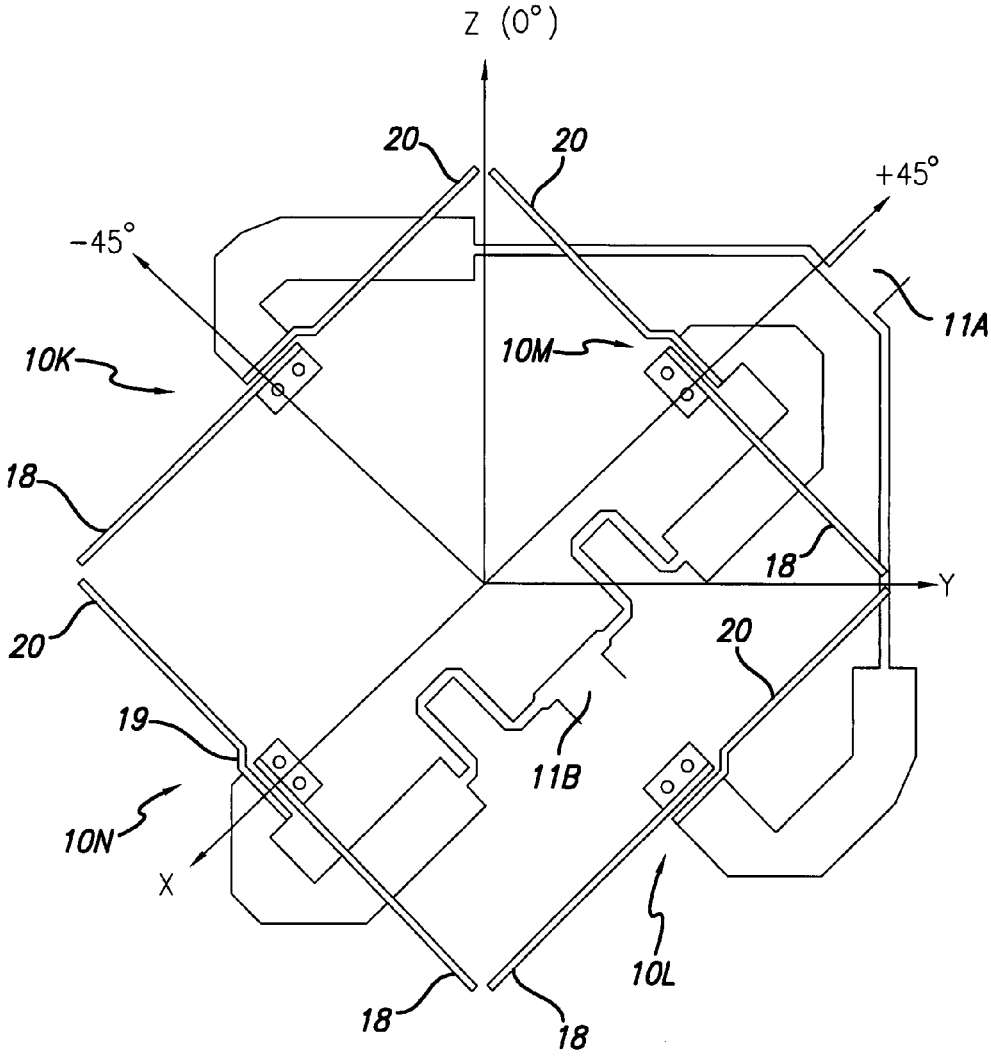

FIGS. 8*a-d* show top views of four example, box dipole antenna arrangements, with the same box dipole configuration orientation, according to the present invention. Specifically, FIG. 8*a* shows four dipole antennas 10K, 10L, 10M and 10N arranged as a square configuration ±45° polarization radiation element 1A. The antennas 10K and 10L form a +45° polarization dipole pair A, and the antennas 10M and 10N form a −45° polarization dipole pair B. The paired dipole is mirrored, wherein all the ground dipoles are attached to ground through ground plate 12, which is mirrored by the + or −45 degree axis. The arm 18 of each dipole antenna extends from the respective conductive leg in planar form. Similarly, the arm 20 of each dipole antenna extends from the respective conductive leg as a flat element. In FIGS. 8*b-d*, the arms 18, 20 of the antenna 10K are in the same plane. The same holds for the antennas 10L, 10M and 10N. The plane of the arms 18, 20 of the antenna 10K is parallel to the plane of the arms 18, 20 of antenna 10L. Similarly, the plane of the arms 18, 20 of the antenna 10M is parallel to the plane of the arms 18, 20 of antenna 10N. FIG. 8*a* also shows +45° polarization axis and −45° polarization axis in relation to the orthogonal X, Y and Z axis in three dimensions. The −45° axis is perpendicular to the plane of the arms of the antennas 10K and 10L. The +45° axis is perpendicular to the plane of the arms of the antennas 10M and 10N. The Y and Z axis form a Y-Z plane which is in the plane of the drawing sheet. The +/−45° axis are in the Y-Z plane. The +/−45° axis are in reference to 0 degree (Z axis).

The X axis is perpendicular to the Y-Z plane (i.e., projecting outwardly from the Y-Z plane). The same axis orientations (i.e., +45° polarization axis, −45° polarization axis and orthogonal X, Y and Z axis in three dimensions) relative to the antennas 10K, 10L, 10M, and 10N, apply to the examples in FIGS. 8*b*, 8*c* and 8*d*. Plural radiation elements 1A can be arranged in an array (row or column) along their Y-axis on a ground plane which is in the Y-Z plane of all the radiation elements 1A. In such an arrangement, the radiation elements 1A have parallel +45° polarization axis in the Y-Z plane, and similarly parallel −45° polarization axis in the Y-Z plane.

FIG. 8*b* shows four dipole antennas 10K, 10L, 10M and 10N, arranged as a square configuration ±45° polarization radiation element 1B, wherein the antennas 10K and 10L form a +45° polarization dipole pair A, and antennas 10M and 10N form a −45° polarization dipole pair B. The arm 18 of each dipole antenna includes an essentially S-shaped section 19 extending from the respective conductive leg. Similarly, the arm 20 of each dipole antenna includes an essentially S-shaped section 19 extending from the respective conductive leg. The section 19 allows maintaining symmetry of the box dipole configuration, and it allows improving the isolation between those input ports or polarizations. The arms 18, 20 of the antenna 10K are in the same plane. The same holds for the antennas 10L, 10M and 10N. The plane of the arms 18, 20 of the antenna 10K is parallel to the plane of the arms 18, 20 of antenna 10L. Similarly, the plane of the arms 18, 20 of the antenna 10M is parallel to the plane of the arms 18, 20 of antenna 10N. The −45° axis is perpendicular to the plane of the arms of the antennas 10K and 10L. The +45° axis is perpendicular to the plane of the arms of the antennas 10M and 10N. Plural radiation elements 1B can be arranged in an array along their Y-axis on a ground plane which is in the Y-Z plane of al the radiation elements 1B.

FIG. 8*c* shows four dipole antennas 10K, 10L, 10M and 10N, arranged as a square configuration ±45° polarization radiation element 1C similar to FIG. 1*a*, wherein antennas 10K and 10L form a +45° polarization dipole pair A, and antennas 10M and 10N form a −45° polarization dipole pair B. The arm 18 of each dipole antenna includes an essentially S-shaped section 19 extending from the respective conductive leg. However, the arm 20 of each dipole antenna is flat extending from the respective conductive leg. The section 19 allows maintaining symmetry of the box dipole configuration, and it allows improving the isolation between those input ports or polarizations. The arms 18, 20 of the antenna 10K are in the same plane. The same holds for the antennas 10L, 10M and 10N. The plane of the arms 18, 20 of the antenna 10K is parallel to the plane of the arms 18, 20 of antenna 10L. Similarly, the plane of the arms 18, 20 of the antenna 10M is parallel to the plane of the arms 18, 20 of antenna 10N. The −45° axis is perpendicular to the plane of the arms of the antennas 10K and 10L. The +45° axis is perpendicular to the plane of the arms of the antennas 10M and 10N. Plural radiation elements 1C can be arranged in an array along their Y-axis on a ground plane which is in the Y-Z plane of al the radiation elements 1C.

FIG. 8*d* shows four dipole antennas 10K, 10L, 10M and 10N, arranged as a square configuration ±45° polarization radiation element 1D, wherein antennas 10K and 10L form a +45° polarization dipole pair A, and antennas 10M, and 10N form a −45° polarization dipole pair B. The arm 20 of each dipole antenna includes an essentially S-shaped section 19 extending from the respective conductive leg. However, the arm 18 of each dipole antenna is flat extending from the respective conductive leg. The section 19 allows maintaining symmetry of the box dipole configuration, and it allows improving the isolation between those input ports or polarizations. The arms 18, 20 of the antenna 10K are in the same plane. The same holds for the antennas 10L, 10M and 10N. The plane of the arms 18, 20 of the antenna 10K is parallel to the plane of the arms 18, 20 of antenna 10L. Similarly, the plane of the arms 18, 20 of the antenna 10M is parallel to the plane of the arms 18, 20 of antenna 10N. The −45° axis is perpendicular to the plane of the arms of the antennas 10K and 10L. The +45° axis is perpendicular to the plane of the arms of the antennas 10M and 10N. Plural radiation elements 1D can be arranged in an array along their Y-axis on a ground plane which is in the Y-Z plane of al the radiation elements 1D.

Figure 9:
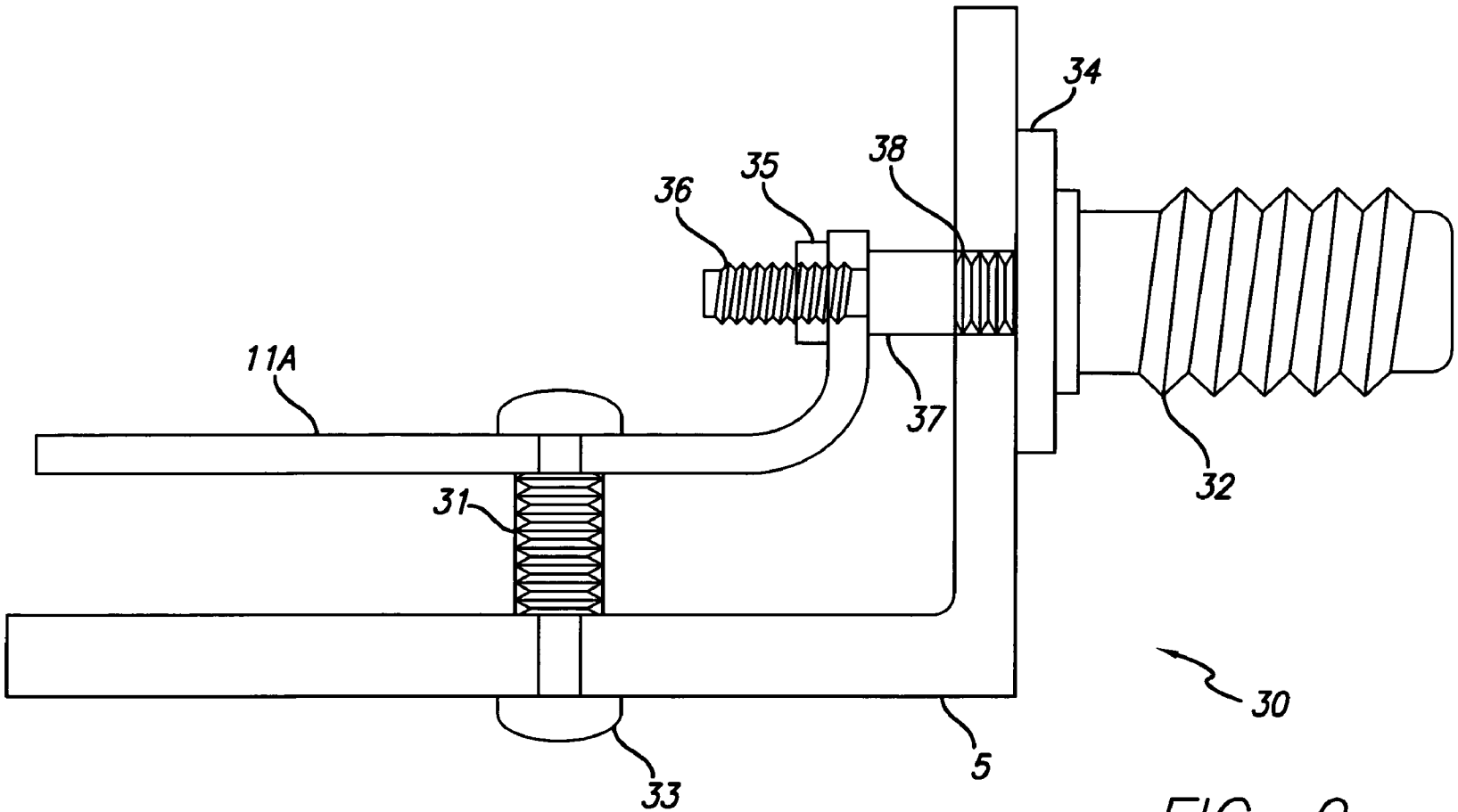
FIG. 9 shows an example 7/16 Din connector to microstrip line transition, according to the present invention.

FIG. 9 shows an example connector 30 for direct coupling to each feed line (e.g., air microstrip lines 11A, 11B) and ground plane 5. The connector 30 includes an electrically conductive cylindrical threaded section 32 for receiving a coaxial cable, a conductive plate 34 for electrically coupling the section 32 to the ground plane 5, and an axial conductor 36 for electrical coupling to a feed line such as feed line 11A. At least a portion of the conductor 36 is threaded for fastening to the feed line 11A via a nut 35, and spaced from the ground plane 5 via an electrically insulating washer 37. The conductor 36 is covered by the insulation sleeve 38 for electrical isolation from the conductive plate 34 and the ground plane 5. The feed line 11A is space from the ground plane 5 by a dielectric sleeve 31 which is held in place between the feed line 11A and the ground plane 5 by an electrically insulating (non-conductive) screw 33. The connector 30 can comprise a modified 7/16 Din connector, which eliminates the typical RG401 input cable cost and assembly costs, and also eliminate the coaxial cable to microstrip transition cost and assembly cost. Another connector 30 can be used for connecting another input to the feed line 11B, in a similar fashion.

The teachings of Application Ser. No. 60/799,241, filed Mar. 3, 2006, for "Broadband vertical polarized base station antenna", the disclosure of which is incorporated herein by reference, may also be employed. The illustrated embodiments are capable of a variety of modifications. Therefore, further aspects of the invention will be appreciated by those skilled in the art.

What is claimed is:

1. An antenna assembly for receiving and/or transmitting electromagnetic signals, comprising:

a dual polarized radiation element comprising a square arrangement of plural radiating elements;

wherein the plural radiating elements form paired dipoles; and balanced feed means, coupled to each of said dipoles, for converting an unbalanced feed input to a balanced feed at the dipole;

wherein the balanced feed means comprises first and second feed elements spaced by an air gap, wherein each paired dipole comprises a pair of radiating elements coupled to the balanced feed means with radiating arms in parallel configuration, wherein a common feed line pattern provides a common input to the feed elements of each paired dipole.

2. The antenna assembly of claim 1, wherein each radiating element comprises a dipole antenna.

3. The antenna assembly of claim 2, further comprising a ground plane wherein each dipole antenna projects outwardly from the ground plane.

4. The antenna assembly of claim 1 wherein each radiation element includes two paired dipoles in a box configuration, wherein each paired dipole comprises a pair of radiating elements in parallel configuration, each paired dipole having a common feed line pattern providing a common input to that paired dipole.

5. The antenna assembly of claim 1 wherein the radiating elements are further oriented such that one paired dipole provides +45° polarization and another paired dipole provides −45° polarization.

6. The antenna assembly of claim 1 wherein the square arrangement of plural radiating elements provides better than 30 dB isolation between the polarization channels.

7. An antenna assembly for receiving and/or transmitting electromagnetic signals, comprising:

a ground plane;

plural radiation elements, each radiation element comprising a square arrangement of plural radiating elements, wherein the plural radiating elements project outwardly from a surface of the ground plane, and the plural radiating elements form paired dipoles with a common feed line pattern having an unbalanced feed input;

each radiating element comprising a dipole antenna including:

a first conductor extending transversely from a surface of the ground plane and electrically connected to the ground plane, the first conductor comprising a first radiating arm projecting outwardly therefrom;

a second conductor spaced from the ground plane by a dielectric and extending transversely relative to the surface of the ground plane, the second conductor comprising a second radiating arm projecting outwardly therefrom;

wherein the first and second conductors are spaced from one another by an air gap, and the first and second radiating arms project outwardly in essentially opposite directions and are configured in a symmetric balanced configuration; and wherein each paired dipole comprises a pair of dipole antennas with radiating arms in parallel configuration and having a common feed line, each feed line comprising a microstrip feed line coupled to said first conductor, and spaced from said ground plane by an air dielectric.

8. The antenna assembly of claim 7 wherein the first and second radiating arms are essentially in the same plane.

9. The antenna assembly of claim 7 wherein the radiation elements are arranged in a row.

10. The antenna assembly of claim 9 wherein the plural radiation elements are arranged in a row on the ground plane such that the radiation elements have parallel +45° polarization axis, and parallel −45° polarization axis.

11. The antenna assembly of claim 7 wherein the square arrangement of plural radiating elements provides better than 30 dB isolation between the polarization channels.

12. An antenna assembly for receiving and/or transmitting electromagnetic signals, comprising:

a ground plane;

plural radiation elements, each radiation element comprising a square arrangement of plural radiating elements, wherein the plural radiating elements project outwardly from a surface of the ground plane, and the plural radiating elements form paired dipoles with a common feed line pattern having an unbalanced feed input;

each radiating element comprising a dipole antenna including:

a first conductor extending transversely from a surface of the ground plane and electrically connected to the ground plane, the first conductor comprising a first radiating arm projecting outwardly therefrom;

a second conductor spaced from the ground plane by a dielectric and extending transversely relative to the surface of the ground plane, the second conductor comprising a second radiating arm projecting outwardly therefrom;

wherein the first and second conductors are spaced from one another by an air gap, and the first and second radiating arms project outwardly in essentially opposite directions and are configured in a symmetric balanced configuration; and wherein in each radiation element, each paired dipole comprises a pair of radiating elements with radiating arms in parallel configuration, such that a common feed line pattern provides a common input to the paired dipole.

13. The antenna assembly of claim 12 wherein each radiation element includes two paired dipoles in a box configuration, wherein each paired dipole comprises a pair of radiating elements in parallel configuration, each paired dipole having a common feed line pattern providing a common input to that paired dipole.

14. The antenna assembly of claim 13 wherein in each radiation element, the radiating elements are further oriented such that one paired dipole provides +45° polarization and another paired dipole provides −45° polarization.

15. An antenna assembly for receiving and/or transmitting electromagnetic signals, comprising:

a ground plane;

plural radiation elements, each radiation element comprising a square arrangement of plural radiating elements, wherein the plural radiating elements project outwardly from a surface of the ground plane, and the plural radiating elements form paired dipoles with a common feed line pattern having an unbalanced feed input;

each radiating element comprising a dipole antenna including:

a first-conductor extending transversely from a surface of the ground plane and electrically connected to the around plane, the first conductor comprising a first radiating arm projecting outwardly therefrom;

a second conductor spaced from the ground plane by a dielectric and extending transversely relative to the surface of the ground plane, the second conductor comprising a second radiating arm projecting outwardly therefrom;

wherein the first and second conductors are spaced from one another by an air gap, and the first and second radiating arms project outwardly in essentially opposite directions and are configured in a symmetric balanced configuration;

wherein the first and second radiating arms are essentially in the same plane; and wherein the first and second conductors are spaced in essentially parallel relationship, forming a balanced paired strips transmission line.

16. The antenna assembly of claim 15 wherein:

the first conductor and the first radiating arm form an essentially L-shape; and the second conductor and the second radiating arm form an essentially L-shape.

17. The antenna assembly of claim 15 wherein:

the first conductor and the first radiating arm are formed from a sheet of conductive material; and the second conductor and the second radiating arm are formed from a sheet of conductive material.

18. The antenna assembly of claim 15 wherein the impedance of the paired strips transmission line is adjusted by adjusting the width of the conductor and/or gap between the conductors.

19. The antenna assembly of claim 15 wherein the impedance of the feed line is adjusted to match input impedance of each radiating arm.

20. The antenna assembly of claim 19 wherein the impedance of the microstrip line is adjusted by adjusting the width of the microstrip line and/or the space between the microstrip line and the ground plane.

* * * * *